United States Patent [19]

Monot

[11] 4,143,434

[45] Mar. 13, 1979

[54] FOLDING COT

[75] Inventor: Christian Monot, Dijon, France

[73] Assignee: Societe Nouvelle Youpa-La, France

[21] Appl. No.: 860,112

[22] Filed: Dec. 13, 1977

[30] Foreign Application Priority Data

Dec. 15, 1976 [JP] Japan ..... 51-151428

[51] Int. Cl.[2] ..... A47C 29/00

[52] U.S. Cl. ..... 5/99 R; 5/114

[58] Field of Search ..... 5/93, 99 R, 100, 110, 5/114, 112

[56] References Cited

U.S. PATENT DOCUMENTS 3,296,633 1/1967 Riegy ..... 5/99 R 3,699,594 10/1972 Doret ..... 5/99 R 3,800,341 4/1974 Davanzo ..... 5/99 R

*Primary Examiner*—Casmir A. Nunberg

*Attorney, Agent, or Firm*—Robert E. Burns; Emmanuel J. Lobato; Bruce L. Adams

[57] ABSTRACT

In a folding bed comprising two hinged half-shells which form a valise in their closed position and a bed plane with unfolded frame and feet members in their open position, the means for locking said shells and members in the open position are coupled with means for identifying at a distance from one side of the cot the locked, respectively the unlocked position of the locking means.

3 Claims, 6 Drawing Figures

FOLDING COT

This invention relates to folding beds and more particularly to child's cots.

Known folding beds and cots have certain drawbacks, notably mechanical complexity, inaesthetic appearance of the folded bed or cot and, when portable, the necessity of transporting the bedding separately from the folded bed or cot.

It is an object of the invention to provide a folding cot of simple construction portable together with the bedding, of an agreeable aesthetic appearance both when folded and open, and with safety means to ensure the locking of the bed in the open position.

According to the invention, a foldable cot comprises two identical or substantially identical half-shells each including a rectangular panel and a wall protruding perpendicularly or substantially perpendicularly from one face of said panel and extending around three edges thereof, said half-shells being hingedly mounted by the free edges of said panels about the longer opposite edges of a rectangular central part between a closed position in which said walls meet together whereby the half-shells and central part form a valise and an unfolded position in which said panels lie in the plane of the central part, means for locking said half-shells in the unfolded position, the half-shells or the central part carrying foldable frame members retractable into said valise in the closed position and adapted in said unfolded position to open to form sides and ends of the cot in extension of said walls, said half-shells including members adapted in said unfolded position to form feet for supporting the cot, characterized by means for identifying at a distance from one side of the cot, the locked, respectively the unlocked position of the locking means.

The invention will now be described, by way of example, with reference to the accompanying drawings, in which.

Figure 1:
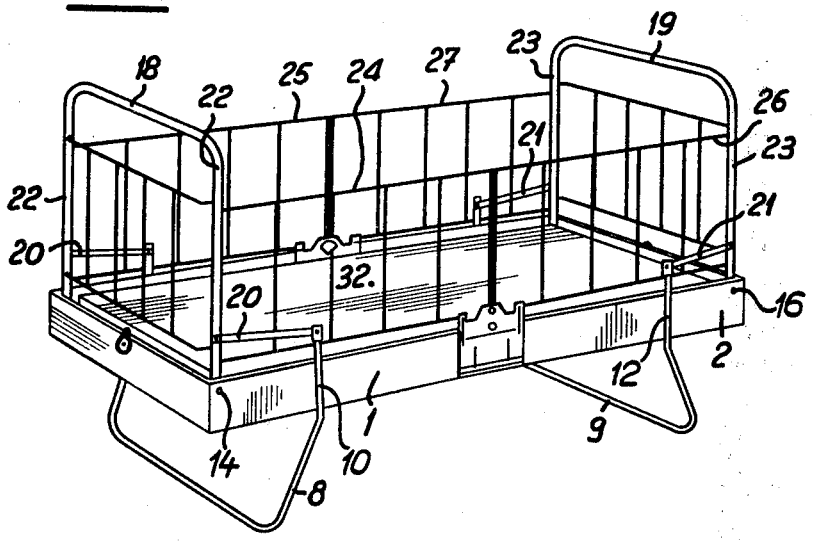
FIGS. 1 to 4 are perspective views of an embodiment with the cot in erected, partially folded, folded flat, and stored position respectively.

Referring to FIGS. 1 to 5, the illustrated embodiment of cot includes two rigid half-shells 1 and 2, for example of a synthetic material, each including a rectangular main panel P1, P2 respectively (see FIG. 2) and a wall perpendicular to the upper face of each main panel and extending around three edges thereof, as indicated at W1, W1', W1'', and W2, W2' and W2'' respectively. The half-shells 1 and 2 are pivotally mounted at their free edges, i.e. opposite to walls W1', W2' to the longer opposite sides of a rigid rectangular central part or panel 5 by means of hinges 3 and 4. Said half-shells 1 are thus able to pivot between a closed position (FIG. 4) in which said walls W1, W1', W1'' and W2, W2' and W2'' meet together whereby the half-shells 1 and 2 and central panel 5 form a valise, and an unfolded position (FIGS. 1 and 3) in which panel P1, P2 lie in the plane of panel 5.

The half-shells could, alternatively, be in a supple material, for example a fabric, on a rigid frame.

Panel 5 is of a slightly lesser length than the separation between the opposite walls W1, W1'' and W2, W2'' of the two shells and is provided towards its ends with rigid upright plates 6 and 7 which are located inside the valise in said closed position.

Half-shells 1 and 2 each have a foot-forming member 8 and 9 respectively, formed of a generally U-shaped tube the arms of which are pivotally connected about axes 10, 11 and 12, 13 to the opposite walls of half-shells 1 and 2.

Half-shells 1 and 2 additionally carry end frame members 18, 19 respectively, pivotally mounted about pins 14, 15 and 16, 17 respectively on said walls W1, W1'' and W2, W2'' adjacent to walls W1' and W2'. End frame members 18 and 19 are respectively connected to the ends of the arms of members 8 and 9 by pivoted arms 20 and 21 respectively. Consequently, when the end frame member 18 or 19 is folded into or out of its half-shell 1 or 2, this movement causes a corresponding folding of the foot-forming member 8 or 9.

End frame members 18 and 19 each have two uprights 22 and 23 respectively, to each of which is pivotally attached a side frame member identified by reference numerals 24 to 27, as shown in FIG. 1.

Figure 5:
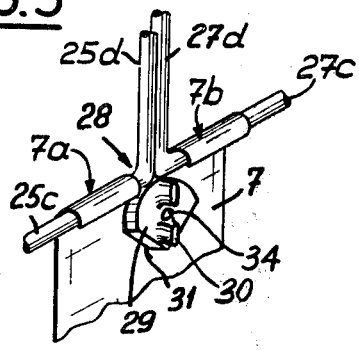
FIG. 5 is an enlarged perspective view of a lock plate of the embodiment, from one side.

Referring to FIG. 5, the side frame members, for example 25 and 27 as illustrated, can be locked together with plate 7. For this purpose, the upper edge of plate 7 carries two inwardly directed channels **7*a* and 7*b* separated by an opening 28. Channels 7*a* and 7*b* are adapted to receive horizontal tubular portions 25*c* and 27*c* of members 25 and 27 respectively whilst vertical tubular portions 25*d* and 27*d* lie together and pass through opening 28. Below edge 28, a cam 29 is pivotaly fixed at 34 on the inner face of plate 7 and is rotatable by means of a button 30 on the outside of said cam. The cam, for example of synthetic material, is partially of circular shape and has a flat 31 so that when the button is turned so that flat 31 faces opening 28, portions 25*c* and 27*c* can be pushed down and removed from or inserted into channels 7*a* and 7*b*, When portions 25*c* and 27*c* are thus placed in the channels 7*a* and 7*b*, the button can be turned so that circular cam surface presses portions 25*c* and 27*c* against the channels 7*a* and 7*b* thereby positionally locking the side and end frame members, foot-forming members 8 and 9, and also the half-shells 1, 2 in said unfolded position. Side-frame members 24 and 26 are similarly locked by like locking means on plate 6** so that the cot can be simply and rapidly locked in its open position.

Of course, other locking devices could be provided to act on the side or end frame members, on the foot-forming members, or on the half-shells 1 and 2, or a combination of any of these means.

Figure 2:
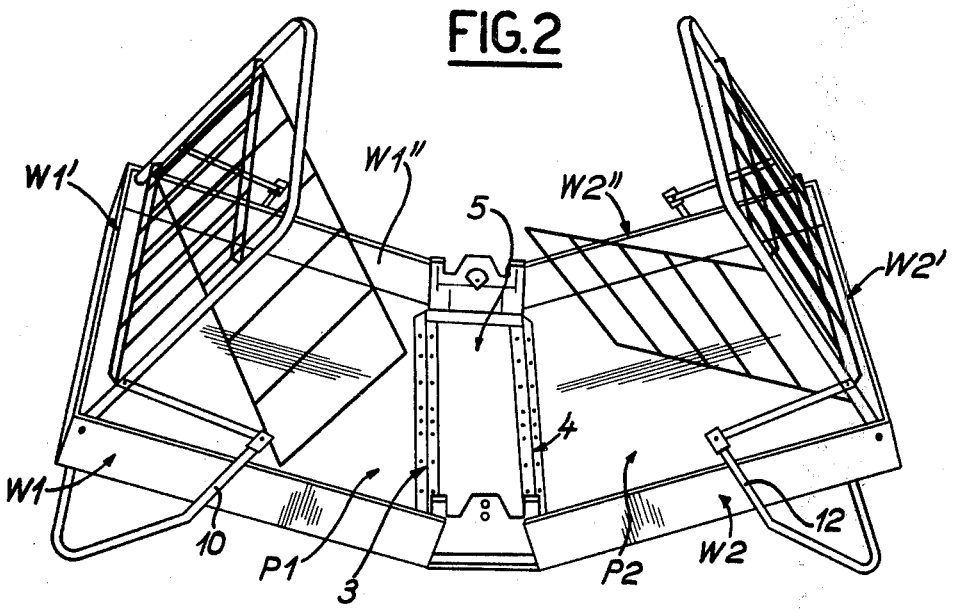
Figure 3:
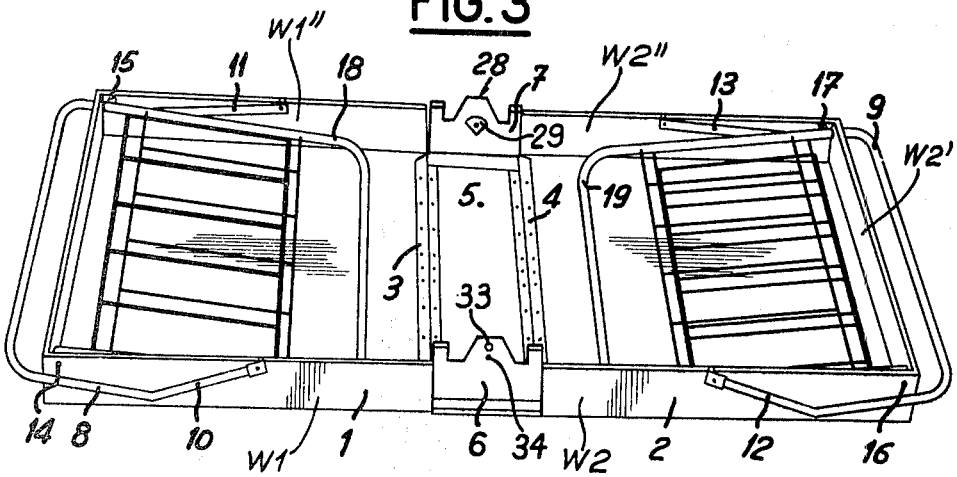
Figure 4:
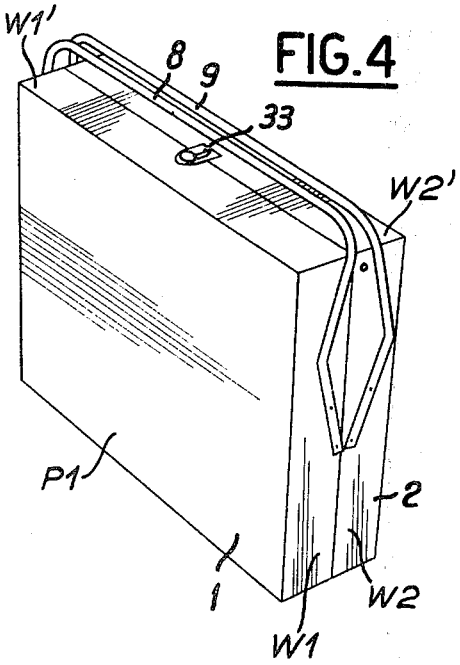

The operation of folding up the cot can easily be understood by considering FIGS. 1, 2, 3 and 4 in turn. Firstly, the locking devices, such as described with reference to FIG. 5, are unlocked and side frame members 24, 26 and 26, 27 are folded against their respective end frame members 18 and 19 as indicated in FIG. 2. End frame members 18 and 19 are then folded flat onto half-shells 1 and 2 as shown in FIG. 3. The two half-shells are then folded together to form a valise and are locked with a standard releasable fastener 33, as shown in FIG. 4. This latter operation brings foot-forming members 8 and 9 together so that they form a handle suitable for carrying the valise.

The bedding 32 is schematically shown on FIG. 1 and is not shown on FIGS. 2 and 3. However, it is understood that the bedding can remain in the cot during the folding and unfolding operations so that the cot, folded into a valise, can be carried with the bedding protected both from the weather and from the possibility of soiling.

Figure 6:
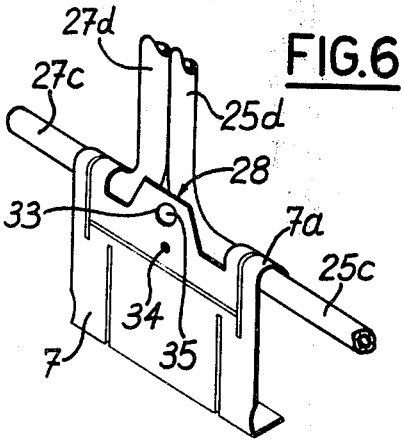
FIG. 6 shows the lock plate of FIG. 5 from the other side.

Turning now more specifically to the locking devices mounted on plates 6 and 7, it is apparent that the cam 29, in its locking or unlocking position, is not visible from outside the bed, because of the disposition of said plates. Therefore, a window has been made in each plate. In FIG. 6, the window of plate 7 is designated by 33. It is located between the axis 34 of rotation of the cam 29 and the top edge of the plate.

In correspondance with this window, an indentification mark 35 is made part of the cam 29, on its surface adjacent to the plate (FIG. 5).

It is now clear that when the cam is in its locking position, as illustrated in FIG. 5, the identification mark 35 shows through the window 33, as indicated in FIG. 6. A person looking at the cot from the outside will see the indentification mark, which can for instance be a colour, like green, saying: "this side of the cot is safely locked." The same verification can be made on the other side of the cot.

On the contrary, if the cam is not in the final locking position, the identification mark will not show through the window. This is particularly true when the non-circular peripherical part 31 of the cam is turned upwards.

The importance of means for identifying at a distance from outside the cot in the locked, respectively the unlocked position of the locking means can be demonstrated as follows. During the operation of opening up the cot unsufficient care can be given to precisely turning the cams in their locking position. Thereafter a mattress is put on the cot, as well as sheets and blankets which will conceal or mask the inside parts of the plates and the cams which are thereon. It is also possible that sometime after the cot has been correctly opened and prepared, due to movements or vibrations the position of the cam would be changed. Another possibility cannot be completely excluded: that an infant in the bed, playing with the cam, would bring it to rotate and come in an unlocking position. For all these reasons and others, the identification marks outside the cot serve a usefull purpose.

What is claimed is:

1. A foldable cot comprising two substantially identical half-shells each including a rectangular panel and a wall protruding substantially perpendicularly from one face of said panel around three edges thereof leaving a fourth edge free, a rectangular central part disposed between said half-shells and having longer opposite side edges and upright plates at shorter end edges thereof, means hingedly connecting said free edges of said panels of said half-shells respectively to said opposite side edges of said central part for movement of said half-shells between a closed position in which said half-shells and central part form a valise and an open position in which said panels lie in the plane of said central part, foldable frame members carried by said half-shells, said frame members being retractable into said valise when in closed position and forming sides and ends of the cot when in open position, said half-shells including members forming feet to support the cot when in open position, means on said upright plates at opposite ends of said central part cooperating with said frame members to lock said half-shells in open position, said locking means comprising channels on each of said upright plates to receive portions of said frame members and a cam rotatable on an inner face of each of said upright plates between a locked position in which it engages said frame members from said channels, and means visible from outside said upright plates for indicating the angular position of said cams and thereby visually indicating at a distance from outside the cot whether said cams are in locked position or in unlocked position.

2. A foldable cot according to claim 1, in which said indicating means comprises a window in a portion of each of said upright plates underlying said cam and a mark on the inner face of said cam in position to be seen through said window when said cam is in locked position.

3. A foldable bed according to claim 2, in which said mark is of a distinctive color indicating the locked position of said cam when said color is seen through said window.

* * * * *